United States Patent [19]

Cardente

[11] Patent Number: 5,033,719

[45] Date of Patent: Jul. 23, 1991

[54] PORTABLE SAND SCREEN

[76] Inventor: John J. Cardente, P.O. Box 326, Barrington, R.I. 02806

[21] Appl. No.: 570,732

[22] Filed: Aug. 22, 1990

[51] Int. Cl.[5] ..... E04H 17/16

[52] U.S. Cl. ..... 256/24; 256/12.5; 135/118

[58] Field of Search ..... 256/24, 25, 12.5, 23, 256/73; 135/902, 118

[56] References Cited

U.S. PATENT DOCUMENTS

| | | | |
|---|---|---|---|
| 1,828,147 | 10/1931 | Kamman | 135/902 X |
| 2,208,458 | 7/1940 | Julian et al. | 256/25 X |
| 2,348,012 | 5/1944 | Levi | 256/25 |
| 2,709,073 | 5/1955 | Dougherty | 256/24 |
| 2,736,041 | 2/1956 | Maloof | 256/25 X |
| 3,537,688 | 11/1970 | Stein | 135/902 |
| 3,758,062 | 9/1973 | Caldwell et al. | 135/118 X |
| 4,576,364 | 3/1986 | O'Fearna | 256/24 |
| 4,838,525 | 6/1989 | Snow et al. | 256/24 X |

FOREIGN PATENT DOCUMENTS

| | | | |
|---|---|---|---|
| 2522051 | 8/1983 | France | 256/12.5 |

*Primary Examiner*—Andrew V. Kundrat

*Attorney, Agent, or Firm*—Barlow & Barlow, Ltd.

[57] ABSTRACT

A length of fabric supported by aluminum rods forced into the sand providing a "fence" for the purpose of deflecting windblown sand away from beachgoing sunbathers while offering more privacy in a lightweight portable device.

1 Claim, 1 Drawing Sheet

10
7
15
22
23
32
25
9
12
43
44
41
16
14
24

9a

PORTABLE SAND SCREEN

BACKGROUND OF THE INVENTION

The proposed invention relates to the sand that is kicked up by the wind and blown across the beach. This sand usually travels at a height of one foot or less in a light to moderate breeze which is a nuisance to sunbathers that are heavily oiled with suntan oils and sunscreen protection causing the sand to stick to them, their beach blankets, towels and other beachgoing essentials.

SUMMARY OF THE INVENTION

The invention would provide beachgoing sunbathers protection from this windblown sand by use of a length of fabric supported by aluminum rods set upwind at ground level providing the sunbather with a "sand fence" that would deflect the windblown sand to the ground before reaching the sunbather.

A second aspect of the invention would be the fabrics ability to "hide" the sunbather from the majority of other beachgoers allowing them more privacy.

DETAILED DESCRIPTION OF THE PREFERRED EMBODIMENT

Figures 1, 2, 2A:
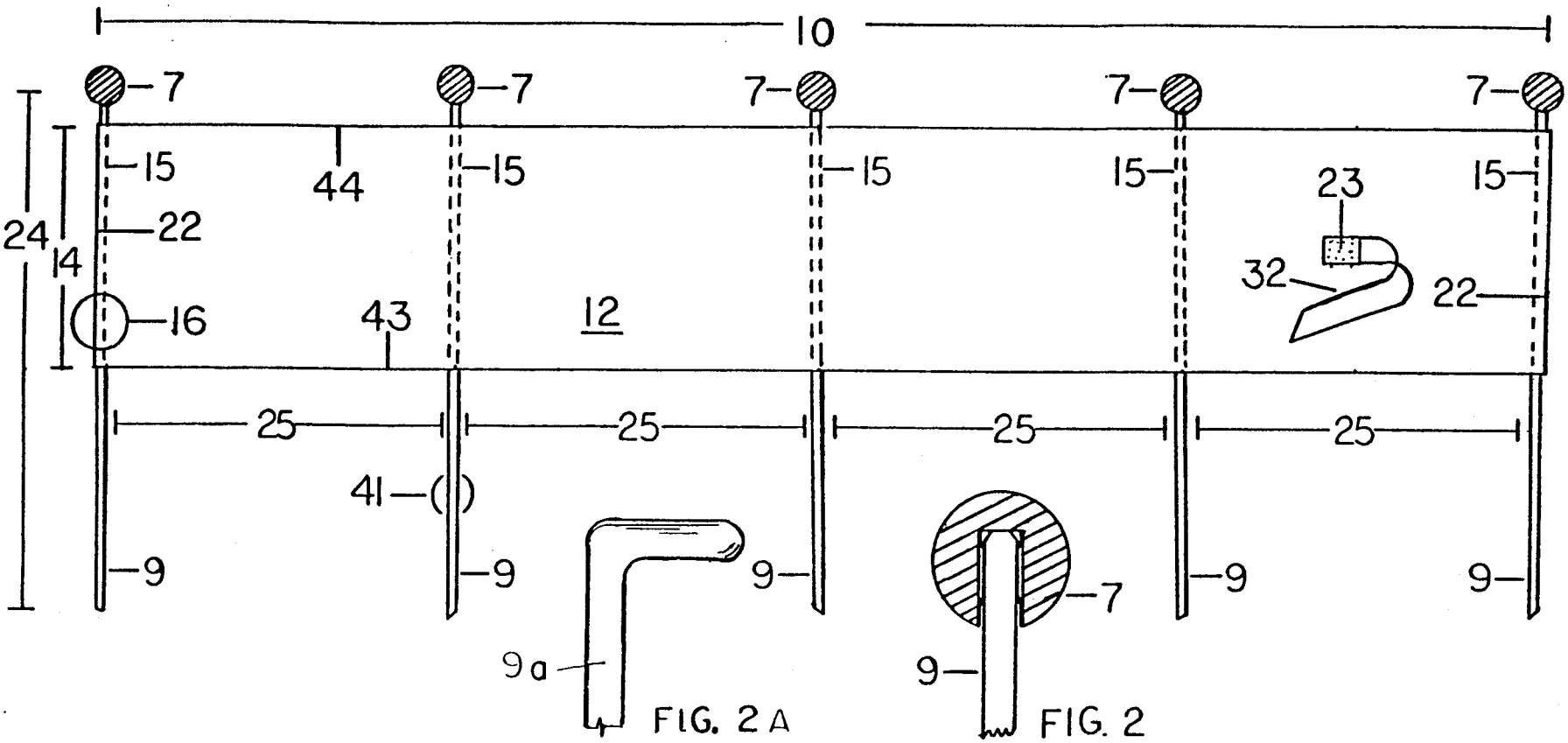
FIG. 1 is a view of the complete invention showing its size specifications of the fabric and its aluminum rods used to hold the fabric in an upright outstretched fashion.
FIG. 2 is an enlarged view of the rods knob pressed onto the top of each of its five rods.
FIG. 2A is an enlarged view similar to FIG. 2, showing an alternate form of the top of a rod.

Referring to FIG. 1, the fabric 12 which runs the length 10 and height 14 is hemmed and sewn 16 on its side edges 22, top edge 44 and bottom edge 43 to prevent the fabric from tearing.

The fabric 12 is then pinched and sewn the full height 14 the distance of 25 allowing a light fitting sleeve 15 for the rods 9 to slide through supporting the fabric 12.

The distance of fabric 12 between the rods 25 is equal to two and one half feet.

The height 14 of the fabric 12, is equal to one foot two inches.

The full length 10 of the fabric 12 is equal to ten feet.

Height 14 and length 10 of the fabric 12 may vary per applicant and manufacturer requirements.

The length 24 of the five aluminum rods 9 is equal to two feet. The diameter 41 of the rods 9 is equal to one quarter of an inch and is topped with plastic press on knobs 7. Rod height 24 and diameter 41 may vary due to applicant and manufacturer's requirements.

Referring to FIGS. 1 and 2, the knobs 7 allow the user to force the rods 9 into the sand providing a "post" allowing the fabric 12 to be pulled taut between the rods 9 the distance of 25. Once all five rods 9 have been forced into the sand, the fabric 12 is taut the length of 10 which can be shaped to the users like depending on the positioning of the five rods 9 providing the user with adequate sand deflection and privacy.

The elimination of the knobs 7 could be accomplished by simply bending the top two inches of the rods 9*a* at a ninety degree angle providing a handle to push and pull the rods 9 to and from the sand as seen in FIG. 2A.

Also, the three inner rods 9 may be left out of their respective sleeves 15 and stationed elsewhere along the fabric 12 providing yet more positioning of the rods 9 allowing more versatility and shapes of the fabric 12.

Having thus described the invention, I claim:

1. A portable sand screen for preventing sand from blowing onto an individual on the beach comprising a length of rectangularly shaped fabric; said fabric being hemmed along its upper and lower edges; said fabric being pinched at spaced locations between the ends of the fabric and stitched together along a line extending between the upper and lower edges to form sleeves, there being intermediate sleeves and end sleeves; a plurality of rods received in said sleeves, each of said rods having an upper end enlargement, said enlargement consisting of at least an angularly bent portion; at least one tab secured to the fabric adjacent one end thereof, said tab being of a length sufficient to wrap around the fabric when rolled up from one end to the other and fastener means on said tab to secure it around said fabric.

* * * * *